US005664439A

United States Patent [19]

Dickerson

[11] Patent Number: 5,664,439

[45] Date of Patent: Sep. 9, 1997

[54] MULTIPURPOSE ORNAMENT AND METHOD OF USE

[76] Inventor: Karin Heidecker Dickerson, 7714 Willow Vine II 205 Blg 34, Dallas, Tex. 75230

[21] Appl. No.: 677,545

[22] Filed: Jul. 18, 1996

Related U.S. Application Data

[63] Continuation-in-part of Ser. No. 418,543, Apr. 7, 1995, abandoned.

[51] Int. Cl.[6] ..... A44L 13/00; A45D 8/22

[52] U.S. Cl. ..... 63/33; 63/29.1; 63/43; 132/278

[58] Field of Search ..... 63/1.1, 2, 29.1; 132/273, 275, 278, 245, 248

[56] References Cited

U.S. PATENT DOCUMENTS 1,078,091 11/1913 Gaunt .

5,097,854 3/1992 Smith ..... 132/278

5,186,186 2/1993 Hamilton ..... 132/275

FOREIGN PATENT DOCUMENTS 493421 11/1927 Germany .

329125 6/1953 Switzerland .

*Primary Examiner*—Flemming Saether

*Attorney, Agent, or Firm*—Michael B. Jolly

[57] ABSTRACT

A multipurpose ornamental and method of use comprising a decorative button, a decorative main body, and a means for securing the button to the main body while also securing the ornament to hair or clothing of the user. The two part system allows the ornament to be changed in appearance by mixing and matching decorative buttons and decorative main body parts to suit the users taste.

10 Claims, 5 Drawing Sheets

MULTIPURPOSE ORNAMENT AND METHOD OF USE

The present application is a continuation-in-part of U.S. Pat. application Ser. No. 08/418,543 entitled "Multipurpose Ornament", now abandoned, filed Apr. 7, 1995.

FIELD OF THE INVENTION

This invention relates to a multipurpose ornament used to secure a persons hair, clothing or belt in place. More particularly, the present invention relates to a two part system comprising an ornamental center button and an ornamental main body. The bottom and main body can be mixed and matched with different buttons and main bodies to alter the appearance of the ornament so that it may be used with a variety of clothing styles and designs.

DESCRIPTION OF THE RELATED ART

The prior art is replete with ornamental devices which both secure hair or clothing and provide an attractive addition to the users appearance. A decorative ponytail holder utilizing an elastic band with bunched fabric has been disclosed by REVSON U.S. Pat. No. 5,301,696. A multipurpose ornamental hair retaining device utilizing a locking elastic retainer is disclosed by HAMILTON U.S. Pat. No. 5,186,186. ENSELLEM, U.S. Pat. No. 5,062,436 discloses a hair barrette which incorporates an ornamental pin. These prior devices exemplify the desires of a fashion conscious public who demand devices which not only provide utility but also exhibit an attractive appearance. The prior devices, although providing utility, do not provide the consumer with a device which can be used with many clothing styles, colors, or occasions. Accordingly, there remains a need for an ornamental device which provides both utility in securing ones hair or clothing in place but also providing a system which can be custom matched to ones clothing thereby obtaining a desired look or fashion.

SUMMARY OF THE INVENTION

According to the present invention, the multipurpose ornament utilizes a two piece system comprising a decorative center button and a decorative main body. The center button includes a means for retaining the button and decorative main body upon the users hair or clothing while said means also functions as a means for securing the hair or clothing in place. The main body comprises a concave surface portion for receiving the center button and a plurality of apertures through which the retaining means project. The retaining means may be a single elastic band, a multiplicity of elastic bands, a barrette clip or other suitable means which would secure the center button upon the main body while also both securing the ornament upon bundled clothing or hair and securing the bundled hair or clothing in place. The ornament may also be easily altered in appearance by mixing and matching different decorative buttons with different decorative main bodies.

Accordingly, it is an object of the present invention to provide a multipurpose ornamental device that can be used to secure gathered hair or clothing.

It is further an object of the present invention to provide a two piece multipurpose ornamental hair or clothing securing device comprising a decorative center button and a decorative main body.

It is further an object of the present invention to provide a two piece multipurpose ornamental hair or clothing securing device comprising a decorative center button and a decorative main body which can be altered in appearance by mixing and matching center buttons with different main bodies to achieve different looks and appearances of the device.

It is further an object of the present invention to provide an easy to use ornamental device used to secure ones hair or clothing in place.

It is further an object of the present invention to provide a two piece multipurpose ornamental device to be used to secure one's hair or clothing in a desired position utilizing a decorative center button a decorative main body and a means for securing the center button upon the main body while said means also functions to both secure the device upon the user's hair or clothing and secures one's bunched hair or clothing in place.

It is further an object of the present invention to provide a multipurpose ornamental which can be easily altered in appearance and thereby worn with an assortment of clothing styles and designs.

DETAILED DESCRIPTION OF THE PREFERRED EMBODIMENT

Figure 1:
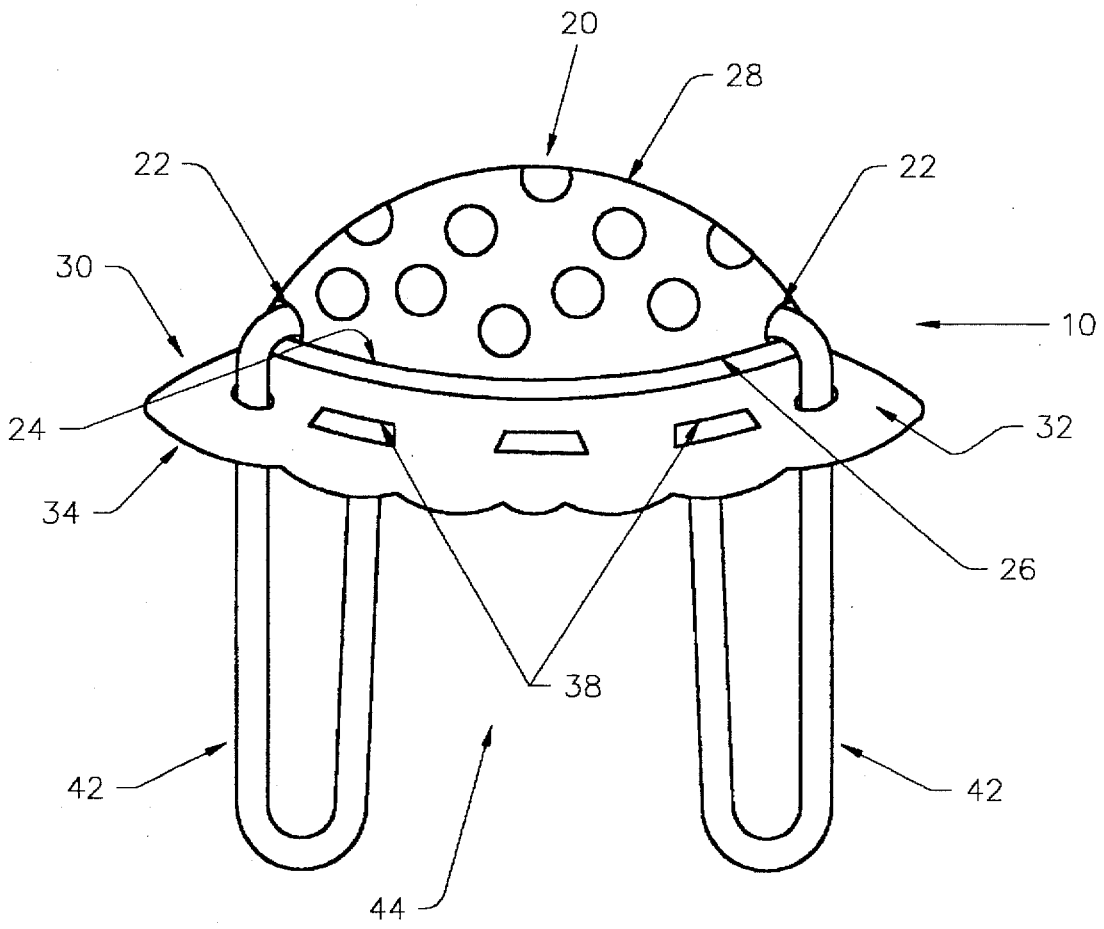
FIG. 1 is a perspective view illustrating the ornamental device.
Figure 2A:
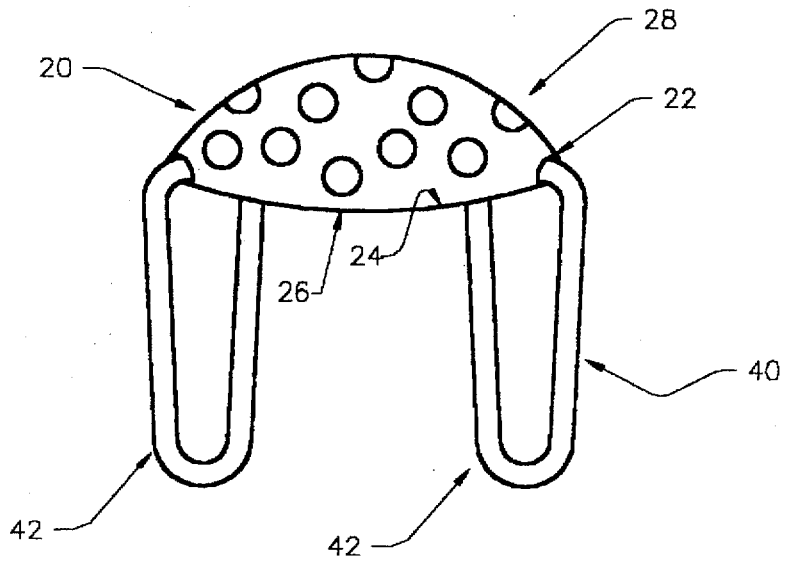
FIGS. 2A–B are plain and top views of the ornamental device's center button and retaining means.
Figure 2B:
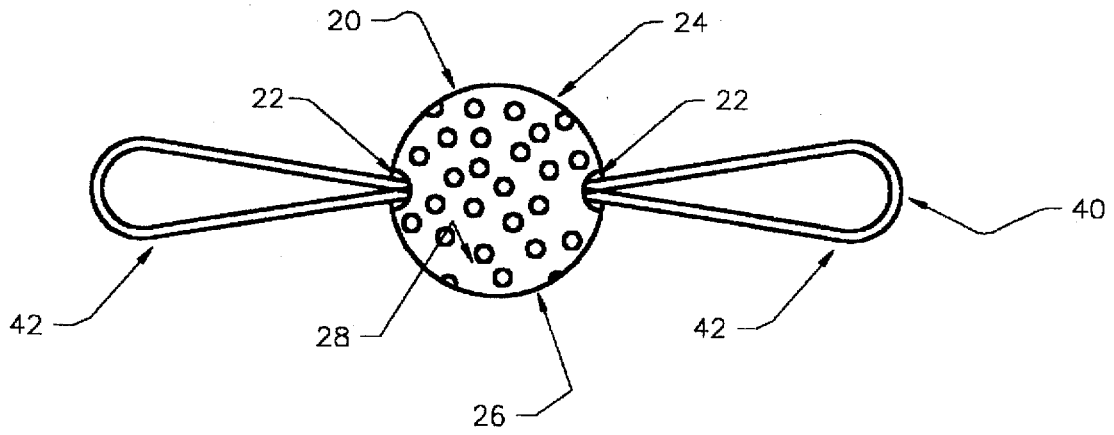
Figure 3A:
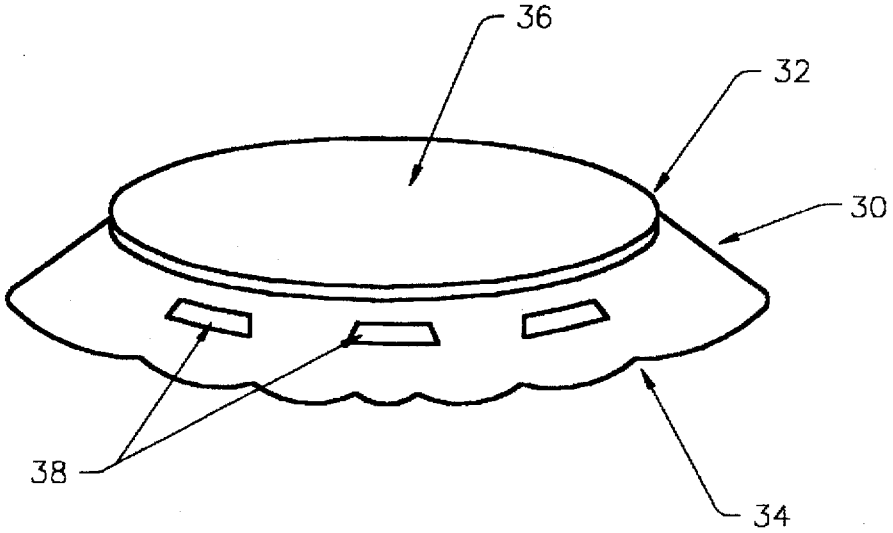
FIGS. 3A–B are plain and top views of the ornamental device's main body.
Figure 3B:
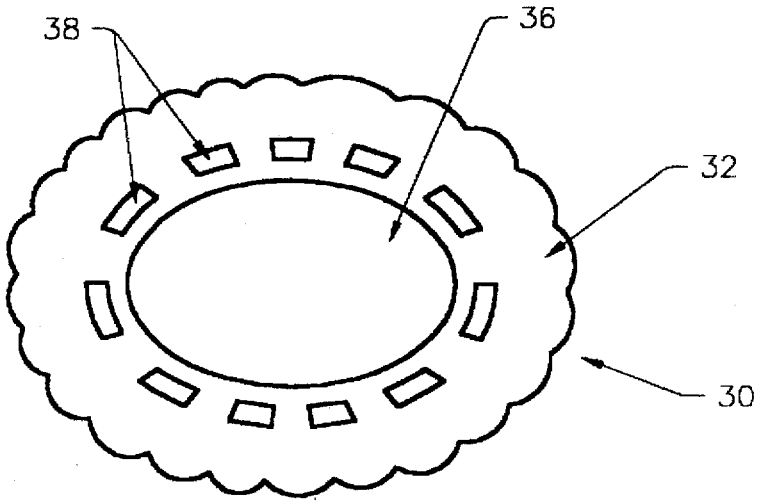
Figure 4A:
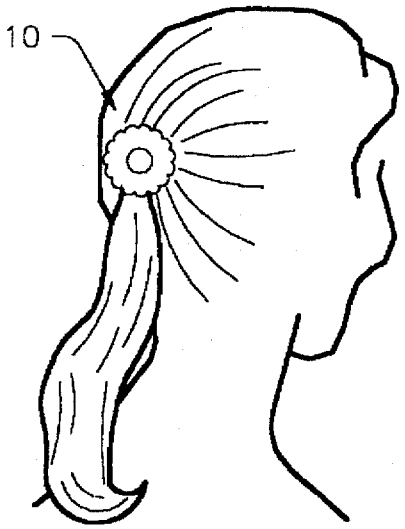
FIGS. 4A–C are illustrations of the ornamental device utilized in securing a user's hair, and clothing, FIGS. 5A,B illustrates the ornamental device constructed with a flexible body.
Figure 4B:
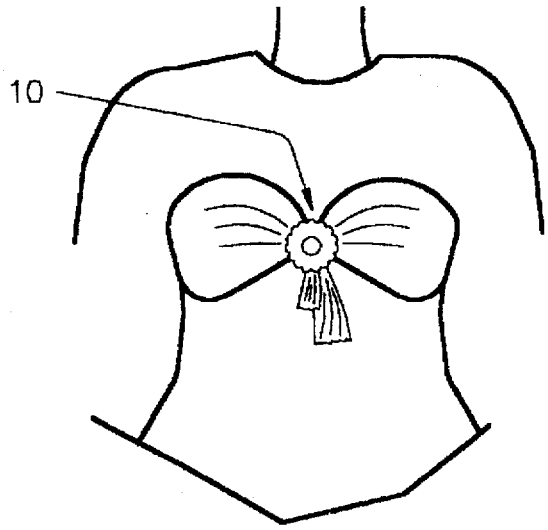
Figure 4C:
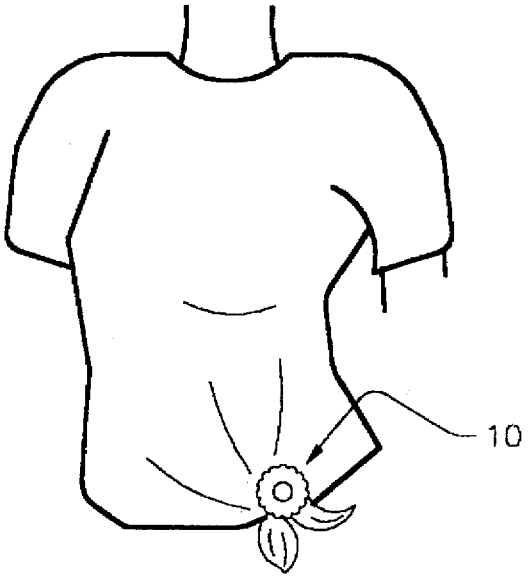

FIG. 1, illustrates the multipurpose ornament 10 including a decorative center button 20, a decorative main body 30, and elastic retaining means 40. FIGS. A–B, illustrates the decorative center button 20 in detail, FIGS. 3A–B illustrate the main body 30 in detail while FIG. 4 illustrates the ornament 10 in use.

The retaining means 40 includes two elastic bands 42 fixedly attached and oppositely positioned upon the button outer edge 24. A means for securing the elastic bands 42 to the button outer edge 24 is disclosed which includes apertures 22 extending through the button bottom surface 26 to the button top surface 28. The aperture should most preferable be sized so that the elastic band fits easily through it and about 1.5 mm to about 4 mm in diameter. An elastic band 42 is secured to the button outer edge 24 by inserting one end of the looped band through aperture 22 and inserting the other end of the band loop through the inserted band loop and pulled so that the band loop tightens upon itself thus securing the band to the button. The retaining means may also be composed of one elastic band in such case the button will have one aperture extending from one side of the button outer edge to the opposite side outer edge. The elastic band is inserted through the aperture and pulled so that the band forms two loops projecting oppositely from the button.

The decorative center button 20 is constructed of plastic, wood, metals, minerals, foams, or other suitable materials. The button can further be embellished with desired ornamentation including gem stones, paint, carvings or other suitable items. The elastic bands 40 may be embellished with decorative materials which tend to enhance the ornament's appearance. The button 20 may take any shape including geometric, thematic, seasonal, animal, object, geographic, religious, sports, words, letters, etc. The buttons size should be about 2.5 cm in diameter, however other sizes may be utilized depending upon the application of the ornament desired.

Figure 5A:
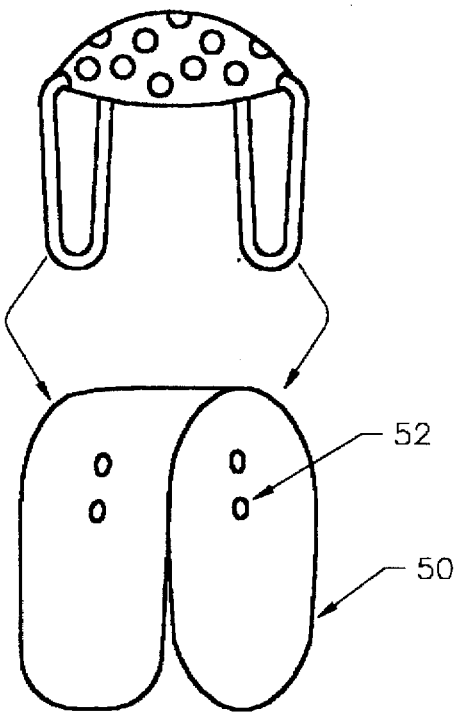
Figure 5B:
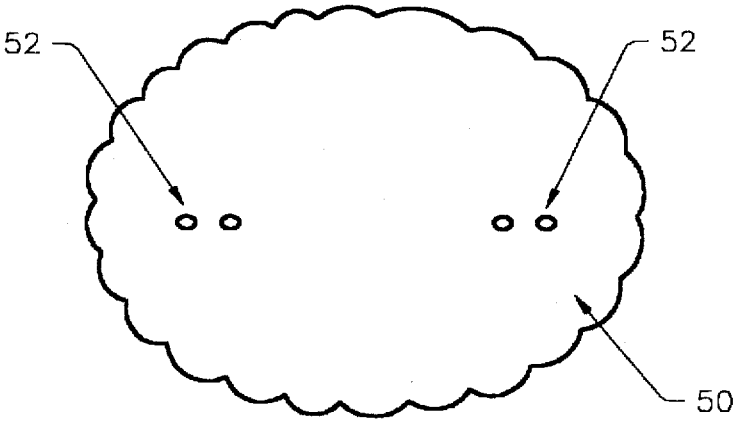

The main body 30 includes top surface 32, bottom surface 34, apertures 38 extending through the main body top surface 32 and main body bottom surface 34, and a centrally located concave receiving area 36. If the main body is designed as a flat flexible body as in FIGS. 5, the centrally located concave receiving area is omitted. The centrally located concave receiving area 36 acts as a receptacle for the button bottom surface 26. The ornament is assembled by inserting looped elastic bands 42 through oppositely positioned main body apertures 38 from the main body top surface 32 to the main body bottom surface 34 until the looped elastic bands 42 extend through the main body 30 and protrude from the main body bottom surface 34. The bands 42 are then pulled until the button bottom surface 26 contacts the main body centrally located concave receiving area 36 as depicted in FIG. 1. As the looped elastic bands 42 are pulled through the main body 30 a bundled object receiving area 44 is created between the two looped bands 42 and the main body bottom surface 34. The bunched object receiving area 44 is the location where bundled hair, clothing, or other objects to be secured are placed. In order to secured bunched objects, a looped elastic band 42 is brought around the item to be secured and inserted back through a main body aperture 38 oppositely positioned from where the elastic band protrudes from the main body 30, the looped band 42 is then stretched and looped around the top surface of the button 28 and placed between the main body top surface 32 and button bottom surface 26. A second elastic band 42 is place around the bunched object and secured in a like manner. The number of main body apertures is most preferably four, having a pair of apertures opposite each other on the main body. The main body 30 may be constructed of plastic, wood, metals, minerals, foam, or other suitable materials. The main body 30 may take many shapes limited only by the requirement that the centrally located receiving area 36 be dimensioned to receive the button bottom surface 26. The main body apertures should be dimensioned to easily receive the elastic bands and most preferably about 1.5 mm to about 5 mm in diameter.

A flexible main body 50 may also be employed, wherein the apparatus is used to wrap around a bunched item desired to be secured in place. The flexible main body 50 is generally shaped as a rectangle being about 7 cm to about 7.5 cm long and about 3 cm wide. Main body apertures 52 are two pairs of apertures oppositely positioned upon the flexible main body 50 and said pairs being positioned opposite and an equal distance from the center of the flexible main body 50. Said apertures having about 1.5 cm to about 2.5 cm of space between the two pairs of apertures and further said apertures generally being positioned upon a line which runs longitudinally through the center of the flexible main body so that one aperture of each pair lies an equal distance from the flexible main body center and apertures in each pair are about 1 cm to about ½ cm separated. The apertures are about ½ cm to about 1 cm in diameter. The space between the pairs of apertures in the center of the flexible main body 50 provides space for receiving the button 20. When button retaining means includes the preferable two bands, the button 20, the flexible main body 50, and the item to be secured are secured in place as described above, however when the looped bands are first inserted through the two apertures 52 closest to the flexible main body center and brought through the two outer apertures to be wrapped under the button 20. The positioning of the second outermost apertures causes the flexibly main body 50 to bend around the object being secured. The flexible main body 50 is most preferable constructed of material which provides sufficient flexibility, such as polypropylene or polyethylene.

I claim:

1. A multipurpose ornamental accessory adapted to securely hold hair or clothing of a user, comprising:

a) a center button, b) a main body having top and bottom surfaces, said top surface having a centrally located concave receiving area, a plurality of apertures extending through the top and bottom surfaces, said apertures being oppositely positioned and located along the perimeter of said centrally located concave receiving area, c) an attachment means fixedly attached to said button wherein said means, extends through said main body apertures further said means functioning to hold the button securely upon the main body while also securing the said main body in place upon the item desired to be secured and further said means securing the user's hair or clothing in place.

2. The multipurpose ornament according to claim 1 wherein the button further comprises a button having top and bottom surfaces, an outer edge, and having two securing means positioned oppositely one another and upon said button outer edge.

3. The multipurpose ornament according to claim 2 wherein said two securing means comprises two elastic bands fixedly secured upon said button outer edge further wherein said elastic bands are inserted through two oppositely positioned apertures upon said main body, and said elastic bands being adapted to loop around bunched hair or clothing desired to be secured and further to support said apparatus.

4. The multipurpose ornament according to claim 3 wherein the button further comprises ornamentation upon said button.

5. The multipurpose ornament according to claim 4 wherein the button comprises a button generally in the shape of a hemisphere of about 1½ cm to about 2 cm in diameter and wherein said ornamentation is positioned upon the rounded surface of said hemisphere and a flat surface of said hemisphere contacting said main body.

6. The multipurpose ornament according to claim 3 wherein the elastic bands are decorative and about 2 inches to 3 inches long nonelongated.

7. The multipurpose ornament according to claim 1 wherein said main body further comprising a main body in the general shape of a flat circle and further being constructed of material of about ½ mm to about 1½ mm thick.

8. The multipurpose ornament according to claim 1 further comprising an attachment means having at least two elastic bands oppositely positioned and fixedly attached to said button outer edge.

9. The multipurpose ornament according to claim 1 further comprising an attachment means having two elastic bands.

10. A multipurpose ornament, comprising:

a) decorative button having top and bottom surfaces, an outer edge, two decorative elastic bands, positioned oppositely one another and upon said button outer edge, b) a decorative main body having top and bottom surfaces, said top surface having a centrally located concave receiving area, two pairs of apertures extending through the top and bottom surfaces, said apertures being oppositely positioned and located along the perimeter of said centrally located concave receiving area, c) two securing means comprises two elastic bands fixedly secured upon said button outer edge further wherein said elastic bands are inserted through two oppositely positioned apertures upon said main body, and said elastic bands being adapted to loop around bunched hair or clothing desired to be secured and further to support said apparatus.

* * * * *